United States Patent [19]

Daniels et al.

[11] 4,074,487

[45] Feb. 21, 1978

[54] MULTI-STORY WALL FRAMING SYSTEM AND METHOD

[75] Inventors: Lawrence H. Daniels, Piedmont; Murray C. Hood; Boguslaw Burdzinski, both of Oakland, all of Calif.

[73] Assignees: Kaiser Steel Corporation, Oakland; Custom Rolled Corrugated Metals Co., Albany, both of Calif.

[21] Appl. No.: 436,894

[22] Filed: Jan. 28, 1974

[51] Int. Cl.[2] ..... E04C 3/04; E04H 12/10

[52] U.S. Cl. ..... 52/236.3; 52/263; 52/639; 52/643; 52/655; 52/741

[58] Field of Search ..... 52/236, 263, 637–639, 52/643, 655, 741, 236.3; 182/178, 179

[56] References Cited

U.S. PATENT DOCUMENTS

| | | | |
|---|---|---|---|
| 1,955,818 | 4/1934 | Marshall | 52/236 |
| 2,200,775 | 5/1940 | Henry | 52/655 |
| 2,237,965 | 4/1941 | Kendrick | 52/655 |
| 3,011,586 | 12/1961 | Harvey, Jr. | 182/179 X |
| 3,058,264 | 10/1962 | Varlonga | 52/236 |
| 3,378,971 | 4/1968 | Singer et al. | 52/236 X |
| 3,465,898 | 9/1969 | Klein | 182/178 X |
| 3,638,380 | 2/1972 | Perri | 52/236 |

FOREIGN PATENT DOCUMENTS

| | | | |
|---|---|---|---|
| 1,203,843 | 9/1970 | United Kingdom | 182/178 |

*Primary Examiner*—Alfred C. Perham

[57] ABSTRACT

A wall framing element composed of a vertically extending load bearing member and two obliquely extending brace members which in combination define a generally triangular shape. The obliquely extending brace members are joined to one another at an apex or junction point and a member secured to the junction point affords attachment to the load bearing member of an adjacent element. Telescoping connections at opposite ends of the load bearing member expedite erection of successive stories. Joist members and means for effecting rapid attachment of the joist members are disposed adjacent the upper extremities of the load bearing members. The joist members retain the frame elements in alignment and afford a base for a floor. When erected, the joist members are spaced below the upper extremity of the load bearing members so that the telescoping connection of the elements in the succeeding story can be rapidly effected. A method of erecting a multi-story building frame which employs a plurality of identical frame elements, the resulting frame having the requisite strength and rigidity.

11 Claims, 13 Drawing Figures

MULTI-STORY WALL FRAMING SYSTEM AND METHOD

FIELD OF THE INVENTION

This invention relates to wall and floor framing systems for multi-story buildings and more particularly to a modular system employing a plurality of identical lightweight easily assembled frame elements.

DESCRIPTION OF THE PRIOR ART

U.S. Pat. No. 1,955,818 discloses a frame element composed of four members in rectangular configuration and two diagonally extending brace members. Such elements are prefabricated and then erected to form a wall frame. The framing elements disclosed in the cited patent require two or more men for transporting and erecting them. Moreover, the elements are assembled by joining vertically extending members of adjacent elements so that double stud members occur at modular intervals, a procedure that departs from optimum economy in that double studs are unnecessary and wasteful of material.

SUMMARY OF THE INVENTION

According to the preferred embodiment of the present invention, there is provided a plurality of identical frame elements, each of which is composed of a load bearing stud member formed of sheet metal in a generally C-shaped cross-sectional configuration and two obliquely extending brace members similarly formed. The brace members have first ends which are attached adjacent opposite extremities of the stud and second ends which are joined to one another at a junction point spaced laterally from the stud member. The junction point is adapted for attachment to the stud member of an adjacent element whereby erection can proceed in a rapid and precise manner. In one satisfactory form of the invention, there is an apertured plate mounted at the junction point; the stud member has apertures positioned for registry with the apertures in the plate so as to assure alignment and to expedite erection of a wall employing a plurality of the elements.

An object of the present invention is to provide a frame element that can be handled by one man during its erection. This object is achieved according to the present invention because each element has only one vertically extending load bearing stud member to which brace members of an adjacent element are fastened. The spacing between the stud member and the distal extremities of the brace members is preferably chosen at a uniform distance (e.g., 4 feet) so that a wall frame can be constructed with a plurality of identical elements and so that the frame when constructed will be compatible with other construction materials such as wall panels and the like.

Another object of the present invention is to provide a wall framing system wherein alignment of succeeding stories is assured. This object is achieved by the present invention because of the provision for telescoping connections between the stud members of the elements of one story with the elements in the succeeding story.

Contributing to the achievement of the foregoing object and assuring precise alignment of the elements is a prefabricated plate member that has spaced openings through which the upper extremity of the stud members extend. The plate member thus maintains alignment of the upper ends of the stud members.

Still another object of the present invention is to provide a framing system that minimizes the amount of field assembly time. Contributing to the achievement of this object is the fact that the stud member in each element has predrilled precisely located holes for attachment thereto of joists which typically extend transverse to the wall. Thus, the joists which are also prefabricated are easy to install and serve as aligning and spacing elements between adjacent walls. Moreover, the joists afford support of impervious plates that, in turn, support a cementitious floor placed thereon.

A further object of the present invention is to provide a framing system that achieves the advantages of so-called platform framing in a multi-story building. This object is achieved in part because the system is arranged such that the above-mentioned cementitious floor has a thickness such that the upper ends of the stud member supporting the same are exposed to the upper surface of the floor and provide openings into which frame elements of the succeeding story can be installed. This form of construction not only improves accuracy but affords the advantages inherent in platform framing techniques.

The foregoing, together with other objects, features and advantages, will be more apparent after referring to the following specification and accompanying drawings.

DESCRIPTION OF THE PREFERRED EMBODIMENT

Figure 7:
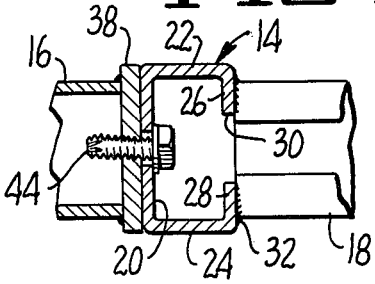
FIG. 7 is a cross-sectional plan view taken along the plane designated by line 7—7 in FIG. 3.

Referring more particularly to the drawings, reference numeral 12 indicates a framing element according to the present invention. Frame element 12 includes an elongate vertically extending load bearing stud member 14, an upper brace member 16 and a lower brace member 18. As seen most clearly in FIGS. 2 and 5–7, each of the members has a generally C-shaped cross-section. More specifically and with reference to FIG. 7, stud member 14 is formed of sheet metal of unitary construction and includes a transverse web 20, face webs 22 and 24 which extend normal from opposite edges of the transverse web, and flanges 26 and 28 which extend from the distal edges of the face webs in parallelism with transverse web 20. Flange 26 and 28 define an opening 30 therebetween to afford access to the interior of the stud.

Figure 3:
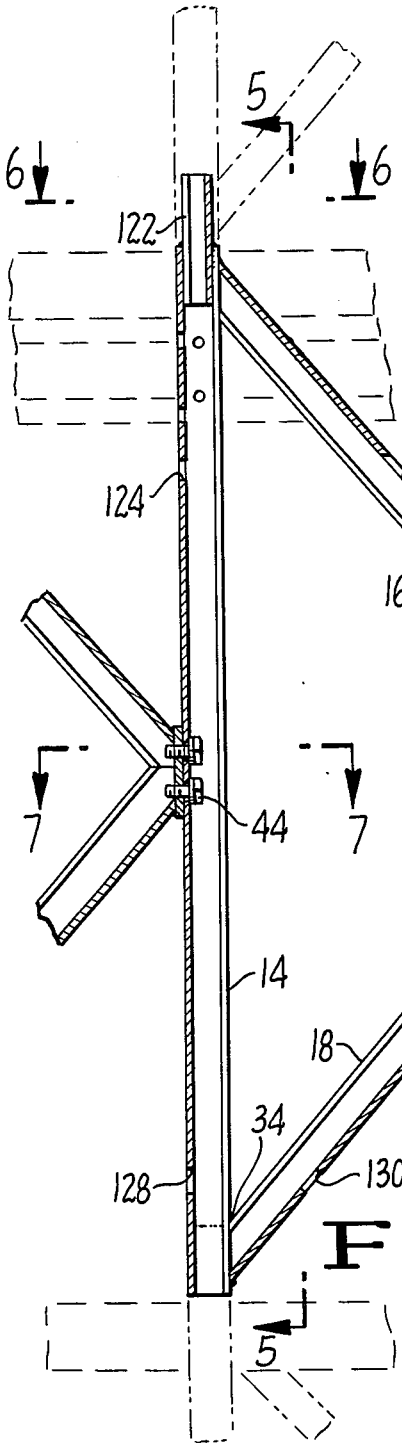
FIG. 3 is an elevation view of a fragment of a wall frame employing a frame element of the present invention.
Figure 4:
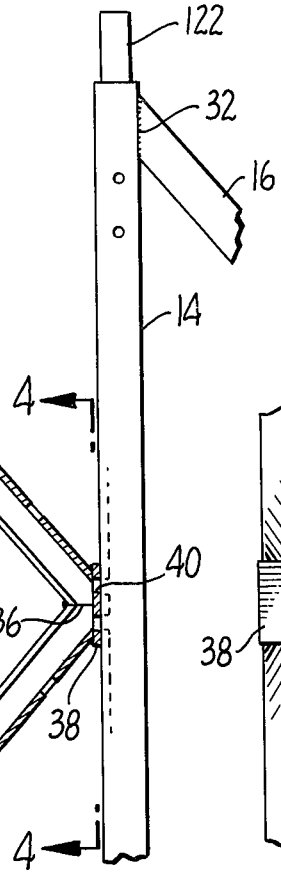
FIG. 4 is a fragmentary side view taken along the plane designated by line 4—4 in FIG. 3.
Figure 4:
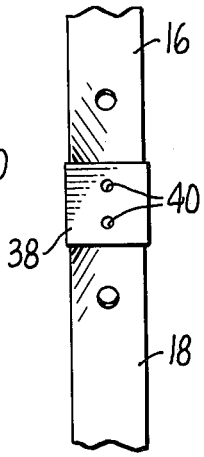
Figure 5:
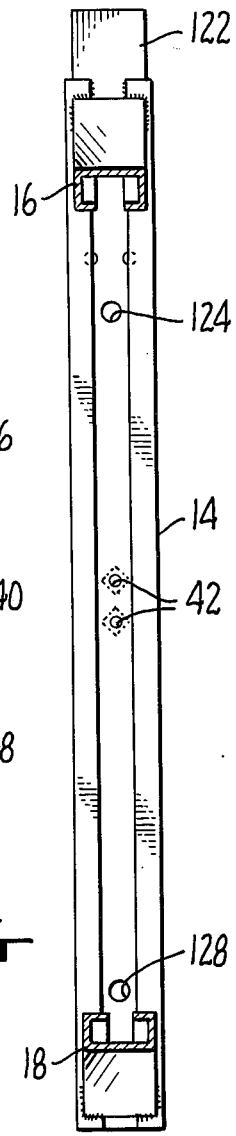
FIG. 5 is a side elevation view taken along the plane designated by line 5—5 in FIG. 3.
Figure 6:
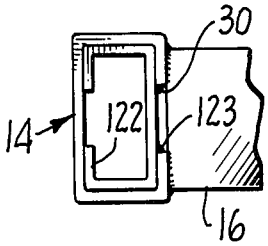
FIG. 6 is a cross-sectional plan view taken along the plane designated by line 6—6 in FIG. 3.

The upper end of brace 16 is fastened to flanges 26 and 28 at the upper end of stud member 14 by a welded miter joint indicated at 32 in FIG. 3. A similar joint 34 secures the lower end of brace 18 adjacent the lower end of stud 14. The opposite ends of braces 16 and 18 are joined at a junction point 36 which, as seen in FIG. 3, is spaced laterally from stud member 14 and at a vertical position between the upper and lower extremities of the stud member. In a typical embodiment stud member 14 has a length of 8 to 10 feet so that junction point 36 is positioned at a height such as to afford convenient access to workmen constructing a wall frame from elements 12. Secured to the outer ends of brace members 16 and 18 at junction point 16 is a plate 38. Plate 38 is disposed in a vertical position, i.e., parallel to stud member 14. Plate 38 defines one or more mounting holes 40, the embodiment shown in FIG. 4 having two such holes that are vertically spaced from one another. Stud member 14 has a pair of corresponding holes 42 in transverse web 20. Holes 42 are spaced from one another by the same distance as holes 40 so as to afford registry between the respective holes and the vertical position of holes 42 is such that stud members of adjacent elements are parallel and vertical when holes 40 register with holes 42. In practice, it is preferred that holes 42 have a diameter sufficient to afford clearance of fasteners and that holes 40 are of a lesser diameter. This permits employment of self-tapping screws 44 for joining the junction point of one element 12 to the stud member of an adjacent element.

Figures 1, 2:
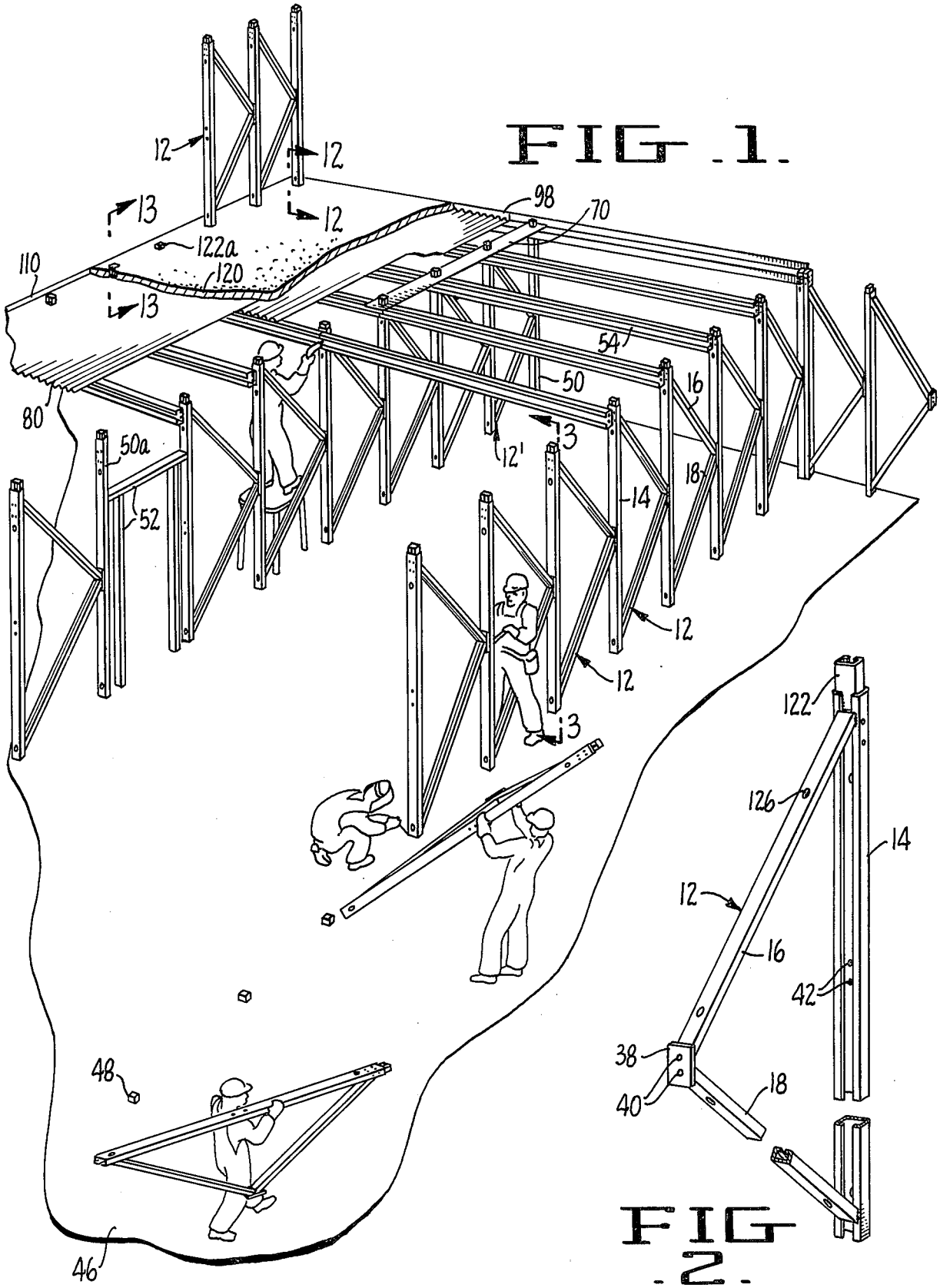
FIG. 1 is a pictorial view of a framing system according to the invention during the construction phase thereof.
FIG. 2 is a perspective view of a frame element according to the present invention.

Before describing the erection sequence of a frame employing the elements described above, certain comments concerning the layout of a foundation for the frame are in order. With reference to FIG. 1, the foundation typically comprises a concrete slab 46 which has a level upper surface from which protrude a plurality of rectangular anchor members 48. The anchor members have base portions (not shown) that are embedded in an retained in concrete slab 46. In laying out the forms for the foundation and anchor members 48, the position of the anchor members is established according to the position of the desired wall frames and the spacing between adjacent elements in the wall frame. For example, the wall frame elements typically have a width of 4 feet and in such typical application of the invention anchor members 48 are spaced precisely on 4-foot centers. A portion of anchor member 48 that protrudes above the upper surface of slab 46 has a cross-sectional shape adapted for entry into the rectangular opening defined by stud member 14 so that the lower extremity of the stud can be telescoped onto the anchor during the erection of the frame. Opening 30 between flanges 26 and 28 affords access for welding stud member 14 to anchor 48 after the stud has been plumbed.

The preferred technique for erecting a wall frame employing the elements of the present invention is to first erect and temporarily support in a plumb position a single stud identified at 50 in FIG. 1. Stud 50 is preferably identical to stud member 14 of frame element 12 and is preferably provided with holes equivalent in size and location to holes 42. An anchor member 48 (not shown) is provided at the edge of the foundation for telescoping engagement by stud 50. Thereafter, a frame element 12' is telescoped over a pre-positioned anchor member 48 and is secured to stud 50 by installation of self-tapping screws 44. It is preferable to refrain from completely tightening the self-tapping screws until top wall members, to be described in more detail hereinafter, are installed. Frame elements 12 are installed in succession until the wall is complete. At locations in the wall where door openings and the like are required, conventional frame members indicated at 52 in FIG. 1 are employed. In order to resume installation of elements 12, an additional single stud **50*a*** is positioned at one side of the opening.

Figure 8:
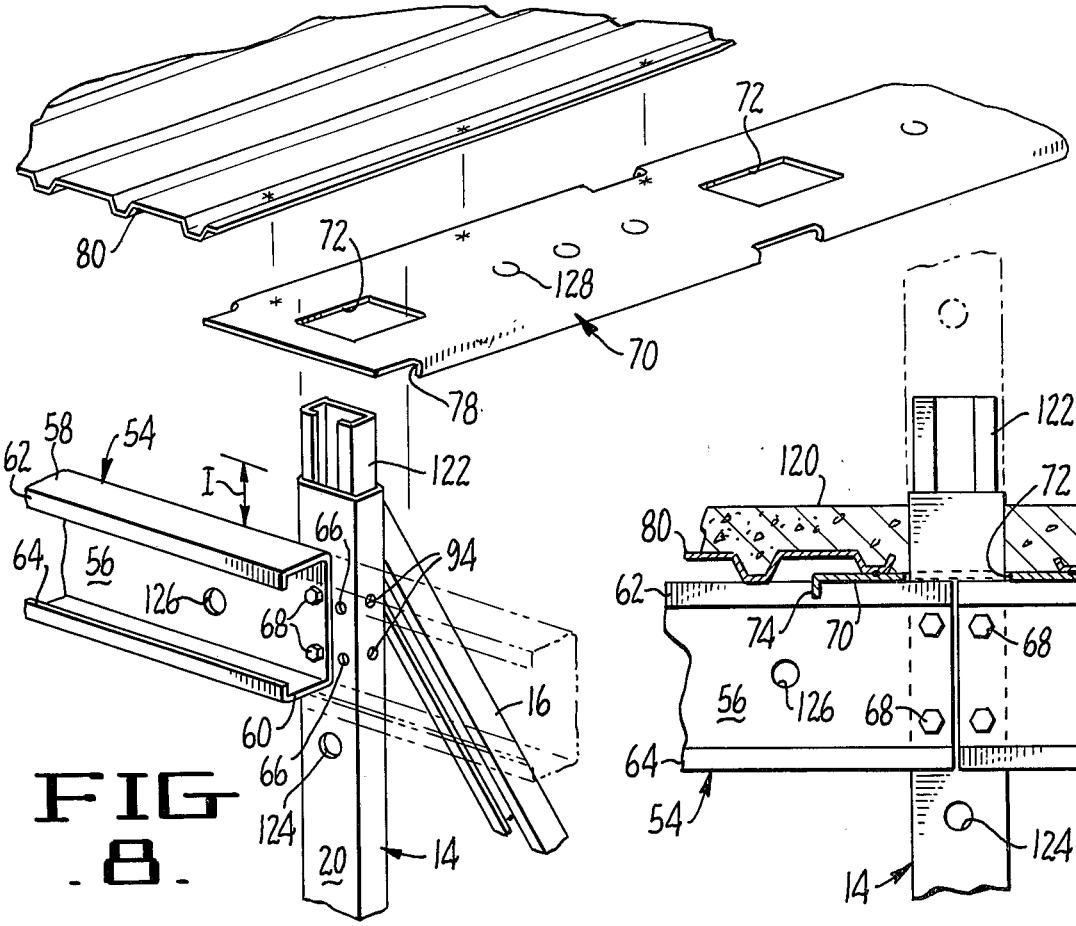
FIG. 8 is an exploded fragmentary perspective view showing the wall plate member and the assembly steps for installing it.

When the wall frames have been erected as described next above, joists 54 are installed. As is clear from FIG. 1, joists 54 are prefabricated to a length corresponding to the distance between adjacent wall frames. With reference to FIG. 8, each joist is of generally C-shaped configuration having a vertical web 56 from the upper and lower edges of which extend horizontal webs 58 and 60. From the distal end of the horizontal webs, flanges 62 and 64 extend in parallelism with web 56. The extent of flanges 62 and 64 is such that the inner surface of vertical web 56 is accessible. At opposite ends thereof, joist 54 is provided with a pair of holes. The holes are spaced from one another so as to register with one of two pairs of holes in transverse web 20 of stud member 14, such holes being identified at 66 in FIG. 8. It is preferred that the holes in the ends of joists 54 be clearance holes and that holes 66 have a smaller diameter in order that self-tapping bolts 68 can be employed to fasten joist 54 to stud 14 of each frame element.

Figure 9:
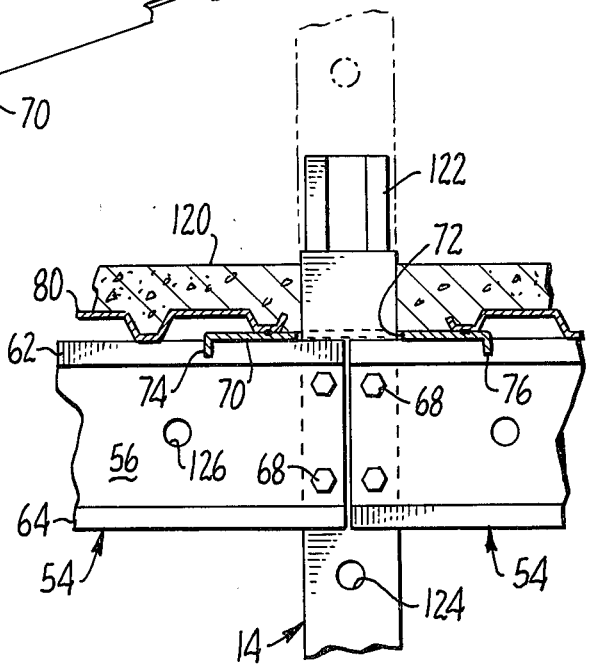
FIG. 9 is a view transverse of a wall constructed according to the present invention showing the joists and floor in place.

FIGS. 8 and 9 indicate that there is an interval between the upper surface of web 58 of joists 54 and the upper extremity of stud member 14, such interval being indicated at I in FIG. 8. Interval I is for the purpose of accommodating the floor structure supported on joists 54 such that the upper extremity of stud member 14 is accessible for affording alignment and installation of the succeeding story.

After joists 54 have been placed transversely to the plane of the individual wall frames, a top plate member 70 is installed parallel with or along each wall frame. At spaced intervals along plate 70 are rectangular cutouts 72 which are sized to snugly fit onto stud member 14 and the portion of brace 16 extending above the upper surface of joist 54. The space between adjacent openings 72 is the same as the space between adjacent anchor members 48 so that installation of plates 70 effects alignment of the upper extremities of the stud members. For strength, plate 70 is formed with depending lips 74 and 76 which are excised, as at 78, to permit plate 70 to lie on the upper surface of web 58 of joist 54. After joists 54 have been installed and plates 70 are in place, the plates can be tack welded to the joists. When this has been completed, bolts 44 can be tightened whereupon an extremely rigid frame is provided.

Impervious corrugated decking 80 is next installed with the corrugations preferably running transverse of joists 54. Because plate 70 extends beyond the transverse extremity of stud members 14, minimal cutting of the decking is necessary. The decking is tack welded to the joists and to plates 70 until an impervious deck is formed overlying the first story of wall frame.

Figure 10:
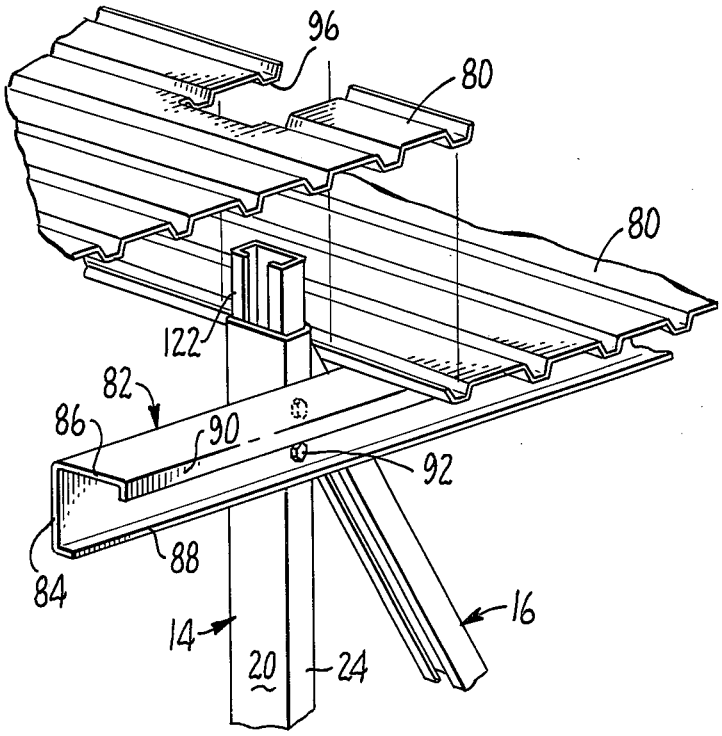
FIG. 10 is an exploded perspective view showing an alternate form of construction to that shown in FIG. 9, such alternate form being employed where the joist members extend parallel to the assembled wall frame.
Figure 11:
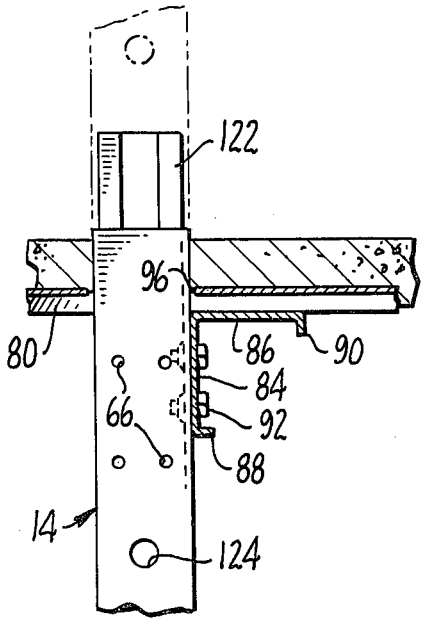
FIG. 11 is a sectional assembled view of the structure of FIG. 10.

In certain applications or in certain regions of a given building frame, it will be necessary or desirable to employ load supporting joists that extend parallel to the wall frames. Such construction may be desirable where the space between adjacent wall frames is relatively short and/or adjacent the perimeter of the building. With reference to FIGS. 10 and 11, there is a horizontal member referred to hereinafter as a deck angle and identified by reference numberal 82. As can be seen in FIGS. 10 and 11, deck angle is of generally inverted L-shaped configuration and has a vertical web 84 and a horizontal web 86. Extending from distal ends of respective webs are reinforcing lips 88 and 90. At intervals corresponding to the lateral dimension of frame elements 12, i.e., the center-to-center distance between adjacent stud members 14, vertical web 84 of deck angle 82 is provided with a pair of clearance holes for receipt of self-tapping screws 92. Face web 24 of stud member 14 is formed with a pair of smaller diameter holes 66 which register with the clearance holes in deck angle 82 in order to expedite installation of screws 92 and assure proper alignment of elements 12. The holes in deck angle 82 and holes 94 are positioned such that the upper surface of web 86 is spaced by interval I from the upper extremity of stud member 14. The distance between holes 94 is preferably different from the distance between holes 66 in order to obviate the possibility of incorrect assembly procedures.

Corrugated decking 80 is installed transverse to deck angles 82 and is excised at 96 to form an impervious deck supported by the frame. The decking is preferably tack welded to the horizontal web of deck angle 82.

At the perimeter of the frame, it is essential to form a rim prior to placing concrete or like cementitious material on the decking. For those portions of the frame extending parallel to the joists, a generally Z-shaped member 98 is employed. See FIG. 12. Member 98 includes a horizontal web 100 from one side of which there is an upward extending web 102 and from the opposite edge there is a downward extending web 104. Web 104 defines clearance holes at appropriate intervals for registry with holes 94 in stud member 14. At equivalent intervals, web 100 defines an aperture so that Z-shaped member 98 can be positioned such that web 100 is spaced by the interval I below the upper extremity of the stud member. The Z-shaped member is secured in place by self-tapping screws 106 and by weldments 108 between web 102 and stud 14. The vertical extent of web 102 is preferably established such as to form a screed or like reference edge which is of assistance in placing and finishing the concrete floor material.

Figure 12:
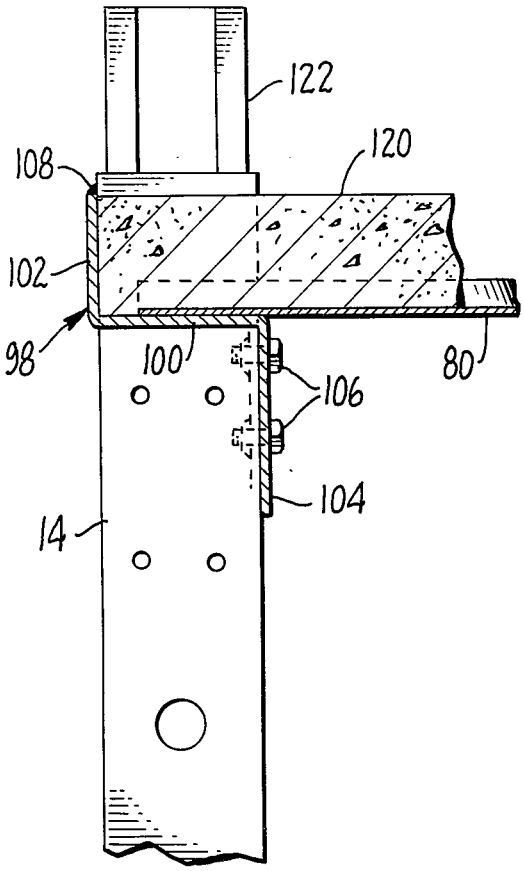
FIG. 12 is a section, taken on the plane designated by line 12—12 in FIG. 1, through an exterior wall at the side of the frame where the wall is parallel to the joists.
Figure 13:
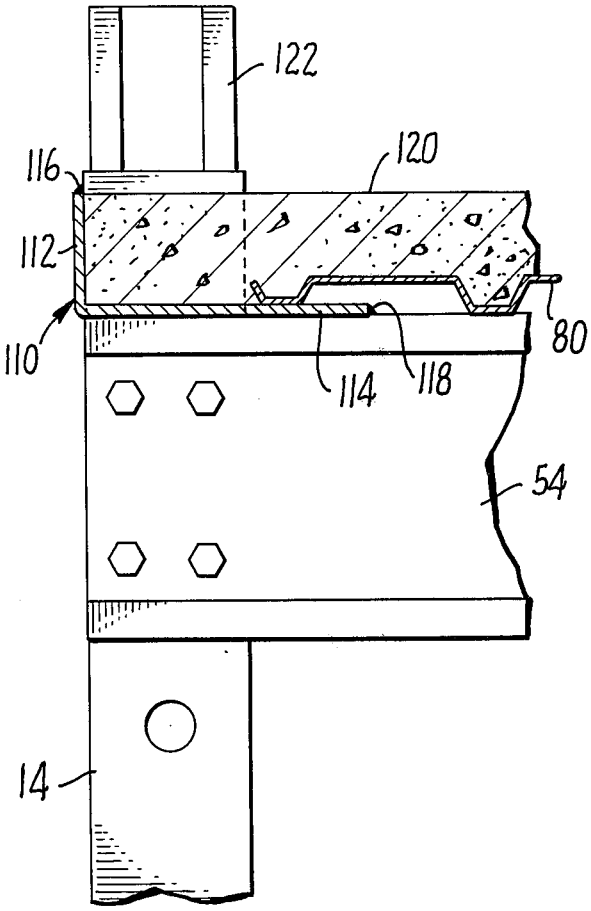
FIG. 13 is a sectional view, taken on the plane designated by line 13—13 in FIG. 1, of an exterior wall where the wall is transverse to the joists.

At portions of the perimeter transverse to the joists there is provided an L-shaped member 110 which includes a vertically extending web 112 and a horizontally extending web 114 (See FIG. 12). Horizontal web 114 is provided with suitably spaced apart rectangular openings for stub 14 and brace 16 so that the member 110 can be placed upon the upper surface of joist 54. L-shaped member 110 is retained in place by weldments 116 and 118, the former being between vertical web 112 and stud 14 and the latter being between horizontal web 114 and joist 54. When When Z-shaped members 98 and L-shaped members 110 are installed, there is an impervious volume totally supported by the frame. Into this volume is placed a cementitious layer 120, the upper surface of which defines a platform from which construction of the succeeding story can be effected.

Secured in the upper end of each stud member 14 of each frame element 12 is a male connector 122, which as seen in FIGS. 2 and 8, has a C-shaped configuration sized to fit within the opening of stud 14. Connector 122 is reversed, however, for additional strength and is fixed to stud 14 by weldments 123. Connector 122 is prefabricated into element 12 and has a length sufficient for telescoping engagement in both the upper and lower stud members. As seen in FIG. 1 at 122*a*, the connectors are accessible from the upper surface of cementitious layer 120 so that succeeding elements 12 for the succeeding story can be readily aligned. Construction of the frame for the succeeding story is effected as described hereinabove. Structures up to 12 stories are feasible by employing the present invention, and the known advantages of platform construction are afforded for each story. Moreover, the completed structure is well braced and conforms with other structural considerations.

Openings and/or knock-outs for utility lines can be provided in the frame members of the invention. For example, an opening 124 in the upper portion of stud member 14 and an opening 126 in brace 16 permit installation of utility lines in the upper region of the wall frames. Similar openings 128 and 130 permit installation of utility lines adjacent the lower portion of the wall frames. Joists 52 can be provided with one or more holes 126 for affording installation of utility lines below the cementitious layer 120, i.e., above the ceiling of the lower story. Plates 70 can be provided with openings 128 for accommodating vertically extending utility lines. Comprehended within the expression "openings" are knock-outs which are well known in the art.

In certain building structures or portions thereof, high loading must be accommodated. The present invention can be employed in such situations by replacing the generally C-shaped stud member 14 and braces 16 and 18 with closed rectangular box sections. In such high strength elements, openings are provided in the walls of the box section to make the weldments referred to hereinabove.

Thus, it will be seen that the present invention provides a multi-story framing system that expedites both design and construction of multiple story buildings. Because the element 12 which is one of the essential aspects of the present invention is composed substantially of three structural members, it is of sufficiently light weight that it can be transported and installed by one workman. Moreover, because the frame elements permit each story to be completed before the next is commenced, the advantages of platform framing are achieved by the present invention.

Although one embodiment has been shown and described, it will be obvious that other adaptations and modifications can be made without departing from the true spirit and scope of the invention.

What is claimed is:

1. A frame element adapted to be assembled in combination with a plurality of like elements to form a composite framework for a building wherein said elements comprise the vertical load carrying structure of the framework and the lateral bracing therefor, said element comprising a load bearing stud member having connectors at either end thereof for engagement with mating connectors of a corresponding element whereby said stud members may be secured together in vertically aligned axial load bearing engagement with one another, said connectors comprising a male member secured at one extremity of said stud member and extending axially thereof and an axial opening formed in the opposite end of the stud member, said opening having a cross-sectional shape substantially congruent to that of said male member to afford telescopic engagement in said opening of the male member of a corresponding element; upper and lower obliquely extending brace members, said brace members having first ends secured to said stud members adjacent the respective extremities thereof and second ends joined to one another in spaced relationship to said stud member at a junction point intermediate the upper and lower extremities of the stud member, said brace members having attachment affording means at the second ends thereof for engagement with the stud member of an adjacent corresponding frame element whereby said brace members may horizontally brace the stud member of such an adjacent frame element.

2. A frame element, according to claim 1, wherein said vertical load bearing stud member includes a C-shaped sheet metal member having a transverse web, first and second face webs extending normal from opposite edges of said transverse web, and first and second flanges extending from the distal edges of respective said face webs in substantial parallelism to said transverse web, said brace members being secured to said flanges, the distal edges of said flanges being spaced apart at the level of said junction point to afford access to the inner surface of said transverse web.

3. A frame element, according to claim 1, wherein said attachment affording means comprises a plate defining a vertical surface adapted for attachment to a stud member of an adjacent element.

4. A frame element, according to claim 3, wherein said vertical surface is spaced from the remote surface of said stud member by a distance of four feet.

5. A frame element, according to claim 3, wherein said plate defines at least one hole therethrough, said stud member having a hole in the transverse web thereof, said holes being positioned so that when the hole in the plate of one element is in registry with the hole in the stud member of an adjacent element the stud elements of said elements are parallel with one another.

6. A frame element, according to claim 1, wherein said axial opening is bounded by a wall, said wall defining an opening for affording access to a male member when telescoped into said opening.

7. A frame structure for a multi-story building comprising first and second parallel wall frames, each said wall frame including a plurality of substantially identical elements, each said element including a vertical load bearing stud member, upper and lower obliquely extending brace members, said brace members having first ends secured to said stud member adjacent respective extremities thereof, said brace members having second ends joined to one another at a junction point disposed at a level intermediate the upper and lower extremities of said stud member, said junction point being spaced laterally of said stud member, and means rigid with said brace members at said junction point for attaching said junction point to a stud member of adjacent element, a plurality of joists spanning the space intermediate said first and second wall frames, said joists being attached to respective said stud members adjacent to but spaced below the upper ends of said stud members so that there is a preselected interval between the upper edge of said joist and the upper extremity of said stud member, first and second deck plates extending along the upper extremity of respective said wall frames and bearing on the upper edge of said joists, a plurality of corrugated impervious members disposed in parallelism with said deck plates to define in cooperation with said deck plates an impervious diaphragm adjacent the upper edges of said joists, a cementitious layer overlying said diaphragm and having a thickness less than said preselected interval so that the upper extremities of said stud members are accessible from the upper surface of said cementitious layer, third and fourth wall frame sections in vertical alignment above respective said first and second wall frame sections, said third and fourth wall frame sections including a plurality of said elements, the lower extremities of the load bearing stud members of the elements of the third and fourth wall frame sections being inter-connected with the upper extremities of respective load bearing stud members in the elements included in said first and second wall frame sections.

8. A frame structure for a multi-story building, said structure comprising: first and second parallel wall frame sections, each of said wall frame sections including a plurality of substantially identical elements, each said element including a vertical load bearing stud member, upper and lower obliquely extending brace members, said brace members having first ends secured to said stud member adjacent respective extremities thereof, said brace members having second ends joined to one another at a junction point disposed at a level intermediate the upper and lower extremities of said stud member, said junction point being spaced laterally of said stud member, and means rigid with said brace members at said junction point for attaching said junction point to a stud member of adjacent element; a plurality of joists spanning the space intermediate said first and second wall frame sections, said joists being attached to respective said stud members and, third and fourth wall frame sections in vertical alignment above respective said first and second wall frame sections, said third and fourth wall frame sections including a plurality of said elements, the lower extremities of the load bearing stud members of the elements of the third and fourth wall frame sections being interconnected with the upper extremities of respective load bearing stud members in the elements included in said first and second wall frame sections.

9. A frame structure for a multi-story building, said structure comprising: a first wall frame section including a plurality of substantially identical elements, each said element including a vertical load bearing stud member, upper and lower obliquely extending brace members, said brace members having first ends secured to said stud member adjacent respective extremities thereof, said brace members having second ends joined to one another at a junction point disposed at a level intermediate the upper and lower extremities of said stud member, said junction point being spaced laterally of said stud member, and means rigid with said brace members at said junction point attaching said junction point to a stud member of an adjacent element; and, a second wall frame section in vertical alignment above said first wall frame section, said second wall frame section including a plurality of said elements, the lower extremities of the load bearing stud members of the elements of the second wall frame section being interconnected with the upper extremities of respective load bearing stud members in the elements included in said first wall frame section.

10. A wall frame section for a building, said section comprising: a plurality of substantially identical elements, said elements being disposed in side-by-side coplanar relationship to one another and each said element including a vertical load bearing stud member supported at its lower end on a foundation, upper and lower obliquely extending brace members, said brace members having first ends secured to said stud member adjacent respective extremities thereof, said brace members having second ends joined to one another at a junction point disposed at a level intermediate the upper and lower extremities of said stud member, said junction point being spaced laterally of said stud member, and means rigid with said brace members at said junction point attaching said junction point to a stud member of an adjacent element.

11. A method for erecting a multi-story building frame comprising the steps of providing a plurality of identical frame elements, each element including a vertical load bearing stud member, upper and lower obliquely extending brace members which have first ends secured to said stud member adjacent respective extremities thereof and second ends joined to one another at a junction point disposed at a level intermediate the upper and lower extremities of the stud member, each element also including means rigid with said brace members at the junction point for attaching the element to a stud member of an adjacent element, erecting first and second rows of said first elements in parallel, uniformly spaced-apart relation, said erecting step including the step of sequentially attaching the attaching means to a stud member in an adjacent previously erected element, providing a plurality of joists, installing said joists in spanning relation between opposite elements in said first and second rows, said installing step being performed so that the upper edges of all said joists lie in a common plane that is disposed below the upper extremities of the stub members by a preselected interval, forming a cementitious floor layer having a lower surface supported on the joists and an upper surface spaced from the lower surface by a distance at most equal to the preselected interval so that the upper extremities of the stud members are accessible from the upper surface of the floor layer, and repeating in sequence said erecting and installing steps from the surface of the floor layer.

* * * * *